US007611033B2

(12) United States Patent
Ganzeboom

(10) Patent No.: US 7,611,033 B2
(45) Date of Patent: Nov. 3, 2009

(54) FOAM DISPENSER, HOUSING AND STORAGE HOLDER THEREFOR

(75) Inventor: Wilhelmus Everhardus Ganzeboom, Haarlem (NL)

(73) Assignee: Technical Concepts Bentfield B.V., Hillegom (NL)

( * ) Notice: Subject to any disclaimer, the term of this patent is extended or adjusted under 35 U.S.C. 154(b) by 334 days.

(21) Appl. No.: 10/841,944

(22) Filed: May 7, 2004

(65) Prior Publication Data

US 2005/0006408 A1 Jan. 13, 2005

Related U.S. Application Data

(63) Continuation of application No. PCT/NL02/00724, filed on Nov. 11, 2002.

(30) Foreign Application Priority Data

Nov. 12, 2001 (NL) ..... 1019348

(51) Int. Cl.
*B67D 5/58* (2006.01)

(52) U.S. Cl. ..... 222/190; 222/105

(58) Field of Classification Search ..... 222/321.8, 222/181.3, 190, 325, 321.1, 321.7–321.9, 222/381, 183, 173, 628, 372, 383.1, 385, 222/105, 106, 100

See application file for complete search history.

(56) References Cited

U.S. PATENT DOCUMENTS

| | | | | |
|---|---|---|---|---|
| 4,477,000 | A | 10/1984 | Arabian | |
| 5,163,588 | A | 11/1992 | Cater | |
| 5,226,566 | A | 7/1993 | Brandenburg | |
| 5,271,530 | A | 12/1993 | Uehira et al. | |
| 5,282,552 | A | 2/1994 | Ophardt | |
| 5,289,952 | A | 3/1994 | Gueret | |
| 5,348,189 | A | 9/1994 | Cater | |
| 5,443,569 | A | 8/1995 | Uehira et al. | |
| 5,445,288 | A | 8/1995 | Banks | |
| 5,556,005 | A | 9/1996 | Banks | |
| 5,570,819 | A * | 11/1996 | Uehira et al. | 222/190 |
| 5,992,698 | A * | 11/1999 | Copeland et al. | 222/325 |
| 6,053,364 | A * | 4/2000 | van der Heijden | 222/145.6 |
| 6,082,586 | A * | 7/2000 | Banks | 222/190 |
| 6,142,338 | A * | 11/2000 | Pellicano | 222/1 |
| 6,412,663 | B1 * | 7/2002 | Adamson et al. | 222/183 |
| 6,619,509 | B2 * | 9/2003 | DeKoning et al. | 222/183 |
| 2003/0071058 | A1 * | 4/2003 | Studer et al. | 222/325 |

FOREIGN PATENT DOCUMENTS

| | | |
|---|---|---|
| EP | 0 019 582 | 11/1980 |

(Continued)

*Primary Examiner*—Lien T Ngo
(74) *Attorney, Agent, or Firm*—TraskBritt PC

(57) ABSTRACT

A foam dispenser comprises a housing having an opening, a fluid reservoir placed in the opening of the housing, a plug connected to the fluid reservoir in the opening, and a foam pump, comprising an air pump, a fluid pump, a closable supply to the air pump, a nozzle, and a movable operating part, wherein the foam pump dispenses a quantity of foam through the nozzle upon actuation of the operating part in a direction of pumping, wherein the foam pump and the fluid reservoir are combined into a removable storage holder. The foam dispenser comprises a coupling piece connected to the foam pump, with which the removable storage holder is fastened to the housing.

20 Claims, 7 Drawing Sheets

FOREIGN PATENT DOCUMENTS

| | | | | |
|---|---|---|---|---|
| EP | 0 079 853 | | | 5/1983 |
| EP | 0 392 238 | | | 10/1990 |
| EP | 0 565 713 | A1 | | 10/1993 |
| EP | 0 613 728 | A2 | | 9/1994 |
| EP | 0 618 147 | A2 | | 10/1994 |
| FR | 2 252 074 | | | 6/1975 |
| GB | 712353 | | | 7/1954 |
| JP | 08-011911 | | | 1/1996 |
| JP | 08-318966 | | | 12/1996 |
| WO | WO 95/26831 | | | 10/1995 |
| WO | WO 96/02178 | | | 2/1996 |
| WO | WO 96/03218 | | * | 8/1996 |
| WO | WO 99/49769 | | | 10/1999 |
| WO | WO 03/059524 | A1 | * | 7/2003 |

* cited by examiner

FOAM DISPENSER, HOUSING AND STORAGE HOLDER THEREFOR

CROSS-REFERENCE TO RELATED APPLICATIONS

This application is a continuation of PCT International Patent Application No. PCT/NL02/00724, filed on Nov. 11, 2002, designating the United States of America, and published, in English, as PCT International Publication No. WO 03/059524A1 on Jul. 24, 2003, which claims the benefit of priority to Netherlands Patent Application Serial No. 1019340, filed on Nov. 12, 2001, the contents of both of which are hereby incorporated by this reference in their entireties.

BACKGROUND OF THE INVENTION

1. Field of the Invention

The invention relates to a foam dispenser including a housing and a fluid reservoir placed in the housing. The housing includes an opening, a plug connected to the fluid reservoir in the opening, and a foam pump. The foam pump includes an air pump, a fluid pump, a closable supply to the air pump, a nozzle, and a movable operating part and is configured to dispense a quantity of foam through the nozzle upon actuation of the operating part in a direction of pumping. The foam pump and the fluid reservoir are combined into a removable storage holder.

The invention also relates to a housing for a foam dispenser configured to receive a removable fluid reservoir and a foam pump, and arranged for operation of the foam pump.

Furthermore, the invention relates to a storage holder, e.g., for liquid soap, configured for placement in a foam dispenser and comprising a fluid reservoir having an opening, a plug connected to the fluid reservoir in the opening, and a foam pump.

2. Background of Related Art

Soap dispensers with foam pumps can, in general, be divided into two categories. Certain variants are in use in hand soap dispensers, consisting of a flexible standing can. A foam pump is screwed into an opening at the top of the can with a nozzle pointing downwards and a dip tube that extends at least partly into the can. The pump is, therefore, located above the level of the fluid reservoir. The soap is pumped upwards. At the same time, air flows into the can via an air supply in the pump to prevent a vacuum from being established in the can. Such a soap dispenser must always be used standing up. If it is held upside down, soap flows through the air supply. There is also a chance of contamination from outside, which may block the air supply. For this reason, the pump and dispenser is not designed to last for a long period of time.

In a different type of soap dispenser having a foam pump, the fluid reservoir is located above the level of the pump. This variant is especially suited for fitting in a bathroom or toilet. The fluid reservoir is used to store the liquid soap and is replaceable so that the foam dispenser can be recharged. In this variant, the pump is fixedly attached to the housing. For this reason, the pump is of a much more robust type. Because the fluid reservoir is located above the level of the pump, parts of the pump continually contact the fluid, due to gravitational effects, and can thus be harmfully affected. The pump must also last much longer, namely, as long as is needed to pump away the contents of a number of the replaceable fluid reservoirs. Replacement of the pump entails having to replace the entire housing and is, therefore, costly.

PCT International Publication No. WO 95/26831 describes a fluid dispenser for dispensing foam. The device includes a collapsible fluid container and a foam pump attached to the container outlet. The foam pump includes two enclosures. The first enclosure is connected to the neck of the container and the second enclosure is telescopically received in the first. In an assembled state, the two enclosures define an air chamber and a fluid chamber, each having an outlet that join together at the foam outlet. The fluid dispenser includes a dispenser housing for detachably receiving the collapsible container and the foam pump. The foam pump may, therefore, be less robust, as the fluid reservoir and pump can both be replaced after use.

A disadvantage of the known apparatus is that the foam pump has been designed especially for this application. The foam pump is only suitable for application in one sort of housing. This makes production of the pump much less economical, as it is manufactured in a small series, especially for this application. When one wants to make different versions of the housing and storage holder, for example, to provide dispensers for different types of fluid, different types of the pump and housing must be made, which further reduces the production series of both the pump and the housing and thus makes manufacturing less economical.

Accordingly, there are needs for an alternative foam dispenser, housings for a foam dispenser, and storage holders which can be manufactured more easily and more efficiently.

SUMMARY OF THE INVENTION

To this end, a foam dispenser according to the invention is characterized in that the foam dispenser includes a coupling piece, connected to the foam pump, with which the removable storage holder is fastened to the housing.

Thus, the foam dispenser has a modular build. It is easy to use a different pump because only an adjustment to the coupling piece is necessary. For this reason, pumps that are also produced for other purposes can be used.

The housing according to the invention includes an adapter for attachment of a coupling piece connected to the foam pump.

The adapter fits within the modular concept of the invention, as in this way, different types of storage holders can be used with one type of housing. The housing need only comprise an adapter associated with the coupling piece.

The storage holder according to the invention includes a coupling piece, connected to the foam pump, with which the removable storage holder can be fastened in the foam dispenser.

This aspect of the invention is also part of the modular concept. By means of the coupling piece, it is possible to make use of existing pumps which are already manufactured in large series. It is also possible to use different variants of the pump by using an adapted coupling piece.

According to an aspect of the invention, the housing is provided with an adapter in which the coupling piece is received, wherein the coupling piece and the adapter are provided with one or more means for fixing and positioning the foam pump.

By these means, it is ensured that the foam always emerges from the foam dispenser in the right direction. For example, if the user must hold his hand underneath the dispenser, the nozzle should always point downwards. This is automatically ensured, as the reservoir with the pump and coupling piece can only be positioned in the adapter in one manner.

Preferably, the adapter is provided with resilient means that are supported by the coupling piece and with one or more latches that restrain the coupling piece in the adapter under tension.

When the storage holder needs to be replaced, the coupling piece is released and at least partly pushed out of the adapter by the resilient means. This ensures a more comfortable removal from the storage holder.

According to a further aspect of the invention, the housing is provided with a handle, mechanically contacting the operating part of the foam pump, for transferring a force in the direction of pumping.

The user of the dispenser, therefore, pumps by exerting a force on the handle. This has the advantage that the operating part of the pump need not be directly operated. On the one hand, this facilitates the use of a handle with a larger operating surface, which is more comfortable in operation. On the other hand, it is thus possible to shield the pump from its surroundings, as it need not be accessible to a user. In this way, contamination of the supply to the air pump, for example, by the wet hands of a user, is avoided.

The handle may be coupled to the operating part and the foam dispenser further provided with resilient means, supported by the housing and exerting a force opposed to the direction of pumping on the handle. This has the effect of returning the pump to a starting position without leaks after each stroke of the pump, including when the pump starts to move more brusquely towards the end of its lifetime.

According to another aspect of the invention, the nozzle is part of the operating part and the handle is provided with means for aligning the nozzle. The foam, therefore, always leaves the dispenser in the right direction and the user is not surprised by foam landing next to his hands.

According to an aspect of the storage holder according to the invention, the fluid reservoir has a flexible wall, with which the foam pump is connected in a substantially airtight manner. Thus, no air channel is needed for pressure compensation inside the reservoir, as the reservoir is capable of deforming as it empties, until it is ultimately almost completely evacuated. Due to airtight connection, no soap can flow through air channels, for instance, under influence of gravity.

In an embodiment of a storage holder according to the invention, the coupling piece comprises a threaded neck and the foam pump comprises a matching thread with which the foam pump is attached to the coupling piece. In this way it is possible, with the aid of the coupling piece, to couple a pump to the fluid reservoir, which is also suited to being screwed onto bottles. Such pumps are already being manufactured in large numbers. It is, therefore, also advantageous, from an efficiency standpoint, to provide apparatus with which such pumps may be used.

In an embodiment of the storage holder according to the invention, the foam pump has an air passage, of which one end is located in an outer wall of the foam pump facing the reservoir. The coupling piece may be adapted to close off the air passage. This arrangement allows, with the aid of the coupling piece, a pump to be coupled to the fluid reservoir, which is also suitable for hand soap dispensers, wherein the fluid level is below that of the pump and the fluid reservoir is aerated, for instance, because it is not flexible. The advantage is that this pump is manufactured in large series for application in hand soap dispensers. It is efficient and economical to also apply such a pump in the foam dispenser according to the invention.

According to a further aspect of the invention, the coupling piece is adapted to connect at least two parts of the foam pump to each other. The coupling piece thus also performs the function of keeping together the foam pump. This allows a foam pump to be used which is simpler, so that the costs of the foam pump will be lower.

Other features and advantages of the invention will become apparent to those of skill in the art through consideration of the ensuing description, the accompanying drawings, and the appended claims.

BRIEF DESCRIPTION OF THE DRAWINGS

The invention will now be explained in further detail with reference to the accompanying drawings.

DETAILED DESCRIPTION OF THE INVENTION

The invention will be explained with reference to a soap foam dispenser 1. It will be clear that, according to the invention, foaming substances other than soap can also be dispensed. The soap foam dispenser 1 according to the invention is, for example, suited for dispensing a foaming cleaning agent, cosmetics product, etc.

Figure 1:
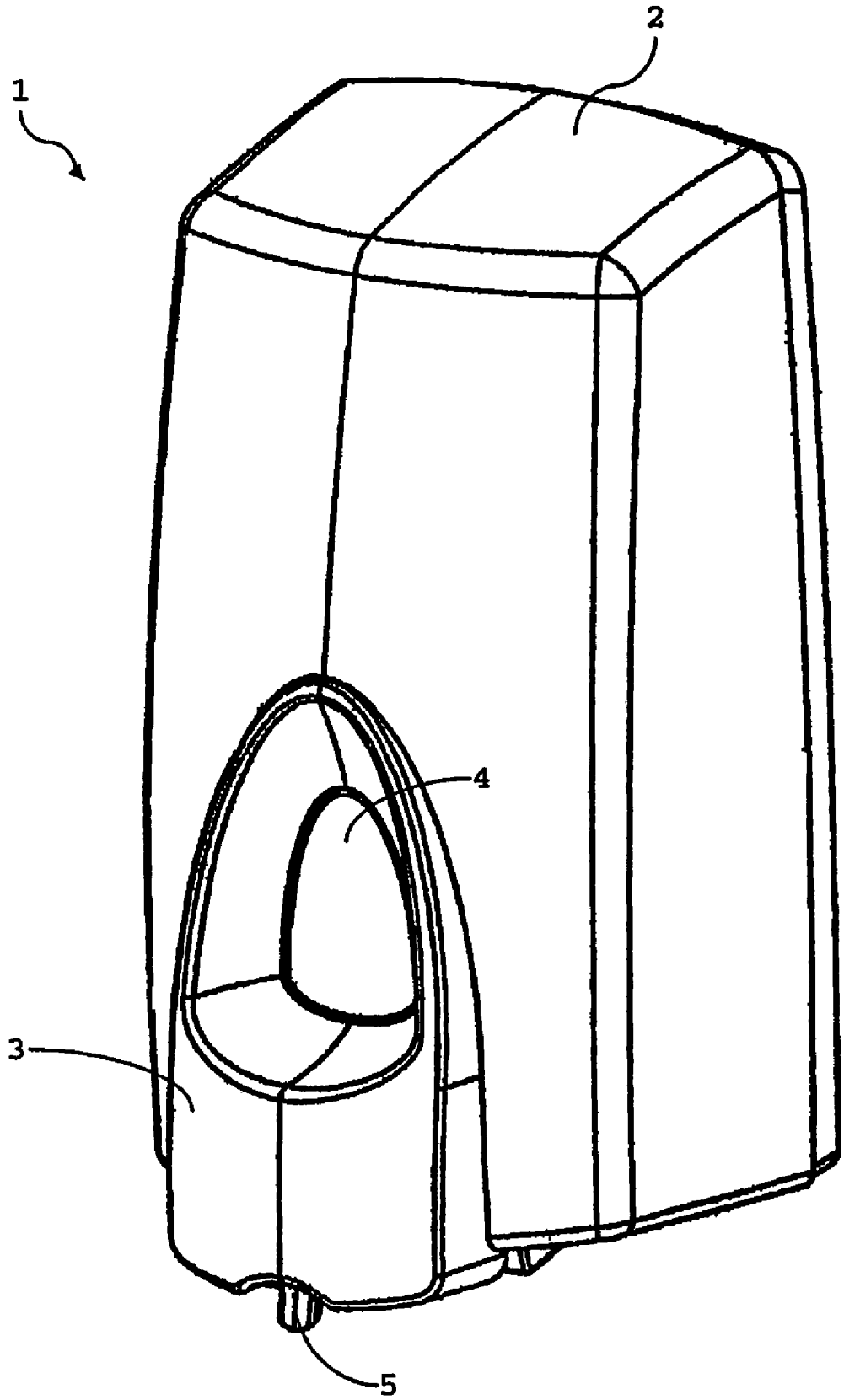
FIG. 1 is a perspective view of an embodiment of a foam dispenser according to the invention.

FIG. 1 shows an example of the soap foam dispenser 1 (also referred to herein as "dispenser 1"). This comprises a housing 2 of which an operating handle 3 forms a part. The housing 2 and the operating handle 3 are preferably made of plastic, e.g., acetal (e.g., POM from BASF), polyamide (PA) or acrylonitrile styrene acrylate (ASA). The operating handle 3 can be made of a plastic different from the housing 2, or have a color different from the housing 2.

A window 4 is provided in the operating handle 3. Through the window 4, a view of the contents of a reservoir that is filled with liquid soap is provided. Thanks to the window 4, one can see how full the reservoir is. An embodiment with a window in the housing 2 is also possible.

Figure 2:
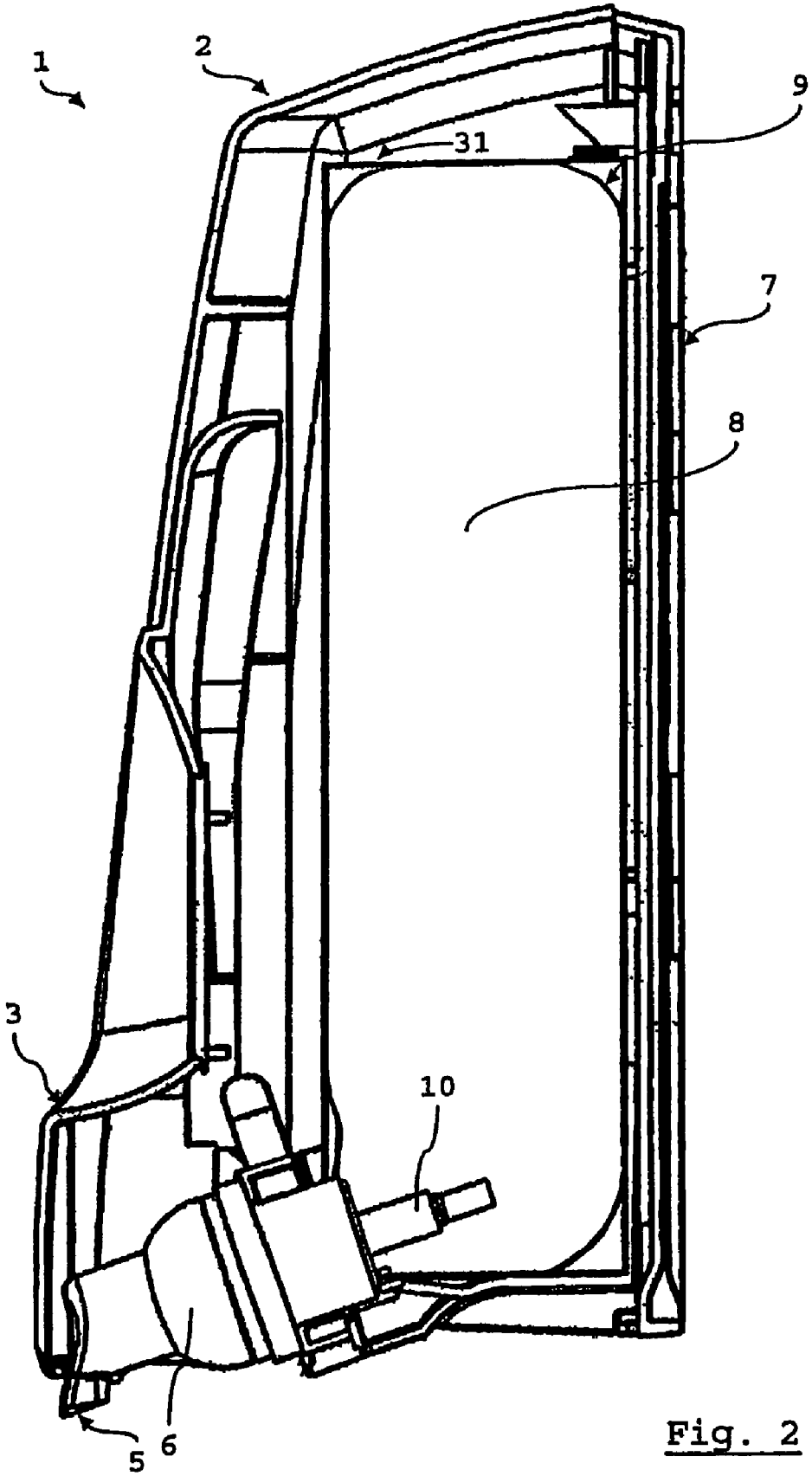
FIG. 2 is a cross-sectional side view of the foam dispenser of FIG. 1.

Just visible in FIG. 1 is a nozzle 5 of a foam pump 6 (FIG. 2). FIG. 1 is taken from a point of view taken obliquely downward toward the front of the dispenser 1. Normally, the soap foam dispenser 1 is attached by its rear side to the wall of, for example, a lavatory space. The user holds one or both hands underneath the nozzle 5 and presses the operating handle 3 with the palms of his hands, whereby a quantity of soap foam lands on his hand(s) by means of the nozzle 5.

FIG. 2 shows a cross-sectional side view of the dispenser 1. In use, a flat rear wall 7 of the dispenser 1 is attached to a wall. To this end, the rear wall 7 is provided with screw holes, for example, or holes by which hooks or other fastening means in the wall can be received. A removable storage holder with a soap reservoir 8, which is also referred to herein as a "reservoir" for the sake of simplicity, has been placed in the housing 2. The soap reservoir 8 comprises a flexible wall, schematically referred to by reference numeral 9. The foam pump 6 is connected to the wall 9 in a substantially airtight manner, as will be explained in further detail below. The wall 9 of the soap reservoir 8 may comprise the wall of a plastic bag.

Good properties of the wall 9 are obtained when it comprises a laminate. An example of such a laminate is a laminate including a layer of polyethylene (PE), a layer of PA, and another layer PE. PE has the advantage that it can be thermally welded so that a stopper or plug can be welded into an opening in the bag. PA is a material that forms a good barrier against soap. The materials of the wall 9 of the soap reservoir 8 may be very flexible. It goes without saying that these materials are proposed merely by way of elucidating example. It is not necessary that the wall 9 comprise a laminate. The wall 9 can also be formed by coextrusion. Other materials may also be used without departing from the scope of the invention, provided that the wall 9 acts as a good barrier for the contents of the soap reservoir 8.

In FIG. 2, the foam pump 6 can also be seen, which is connected to the wall 9 in an airtight manner and thus forms one removable whole with the soap reservoir 8. The foam pump 6 sucks up the liquid soap from the soap reservoir 8 through a short suction tube 10. Thanks to the short suction tube 10, it is also possible to use the storage holder in a dispenser in which the foam pump 6 lies above the bag without the bag having to be completely filled upon delivery. The liquid pump of the foam pump 6 can pump air. It has, however, become apparent that immaculate execution of the first stroke of the foam pump 6 can be ensured by sucking fluid through the suction tube 10. In the foam pump 6, foam is formed by mixing fluid with air, then dispensed via the nozzle 5.

An important advantage of the illustrated apparatus lies in the use of the wall 9 and the airtight connection to the foam pump 6. When a flexible wall 9 is used, no aeration of the soap reservoir 8 is necessary. Therefore, no air holes are needed in a flexible wall 9, and therefore, no measures are necessary to prevent the fluid contents flowing from a soap reservoir 8 that includes a flexible wall 9. As more fluid is pumped up out of the soap reservoir 8, the wall 9 collapses further. No fluid can reach the foam pump 6 from the soap reservoir 8 either, other than through the suction tube 10. This is particularly important because the foam pump 6 lies lower than the fluid in use.

Figure 3:
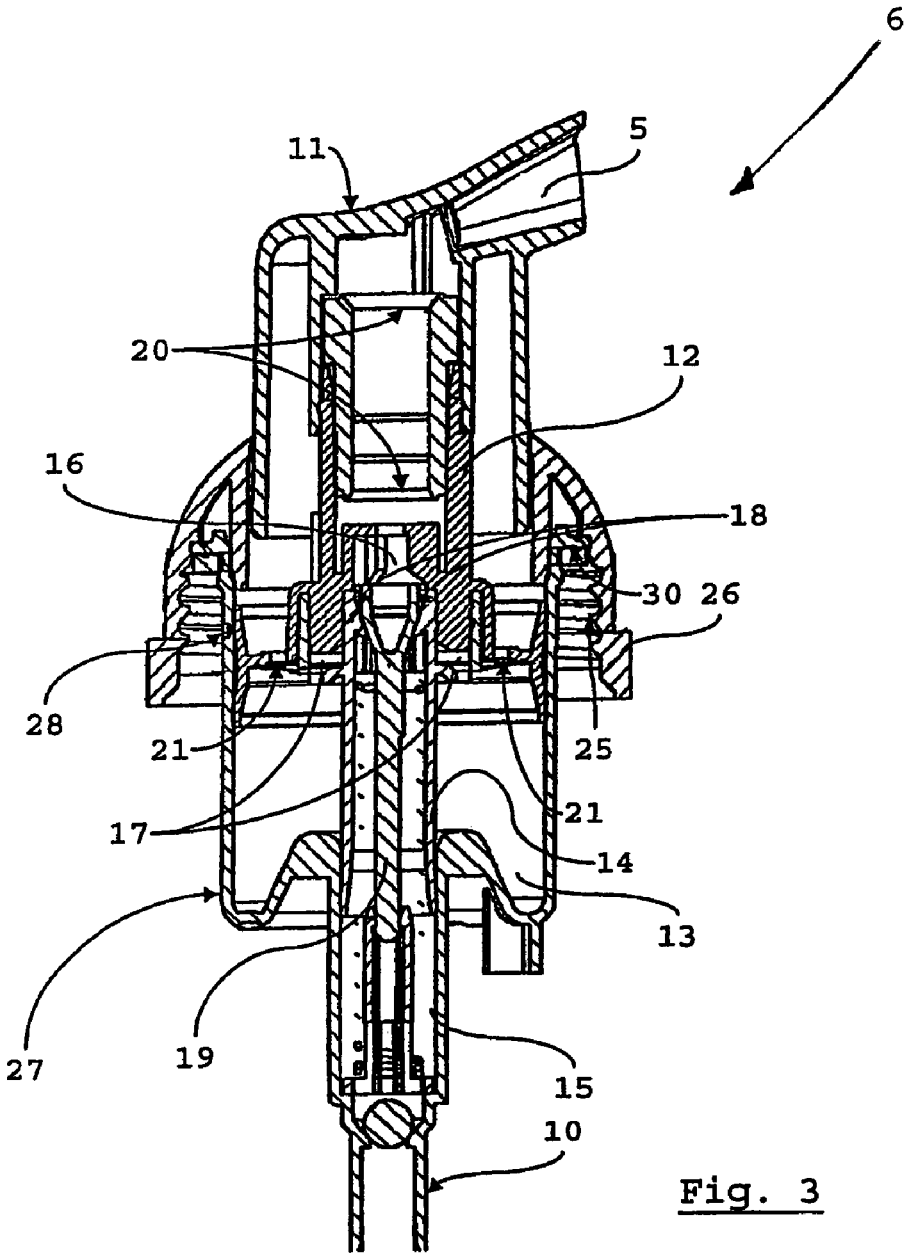
FIG. 3 is a cross-section of the foam pump in the foam dispenser of FIG. 1.

In FIG. 3, a cross-section of the foam pump 6 is depicted to illustrate some of the principles and parts of such a pump. The foam pump 6 is preferably of a type that is also used for hand soap dispensers in the shape of bottles. Such pumps are inexpensive and are produced in large quantities. An example of such a pump is known from U.S. Pat. No. 6,053,364, the disclosure of which is hereby incorporated herein in its entirety by this reference. Accordingly, the following will be confined to a description of the aspects of such a foam pump 6 that are of importance to the present invention.

The foam pump 6 is actuated by moving an operating part 11 in a downward direction, as depicted in FIG. 3. Foam leaves the foam pump 6 through the nozzle 5, which forms an integral part of operating part 11. Actuation of the operating part 11 leads to actuation of an air ring piston 12, which moves in an air chamber 13, and of a fluid piston 14, which moves through a fluid chamber 15. Thereby, air is expelled from the air chamber 13 and fluid is expelled from the fluid chamber 15 to a mixing chamber 16 through openings 17, for example, in the shape of grooves (not visible in FIG. 3) in the fluid piston 14, between the air ring piston 12 and fluid piston 14, and a closable opening 18 between the fluid piston 14 and a central sealing element 19, respectively. Via one or more foam-forming parts 20, situated between mixing chamber 16 and nozzle 5, foam leaves the mixing chamber 16. The foam-forming parts 20 can, for example, be present in the form of perforated plates or meshes.

When the air ring piston 12 moves up to the initial position, pressure within the air chamber 13 is increased. Valves 21, here in the shape of holes which are covered by membranes, open as a consequence of this increased pressure. Air is sucked in from outside, past the operating part 11, which shows some clearance. The air is thus supplied from outside the soap reservoir 8 through an air supply, closable by the valves 21. Because the air is sucked in from outside, no air supply from the soap reservoir 8 is necessary.

Figure 4:
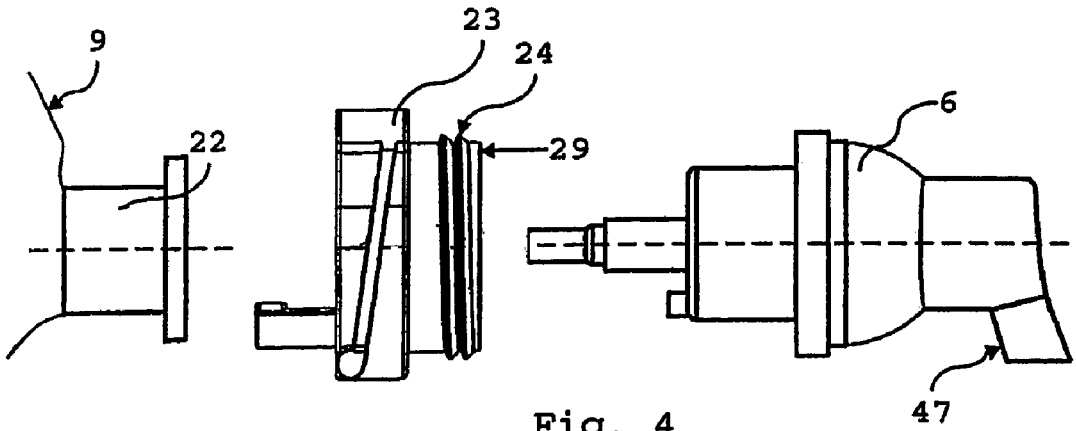
FIG. 4 shows part of the reservoir, the coupling piece and the foam pump prior to assembly into a reservoir according to the invention.

FIG. 4 shows how the foam pump 6 is attached to the wall 9 of the soap reservoir 8. The wall 9 is thermally welded to a plug 22 in an opening in the soap reservoir 8. Bonding is also possible in principle. The foam pump 6 is connected to a coupling piece 23, with which the storage holder, comprising the soap reservoir 8, the foam pump 6, the coupling piece 23, and the plug 22, can be attached to the housing 2.

Guidance edges, not shown, can ensure that the parts 6, 22, 23 are positioned at a correct angle around the longitudinal axis depicted by a dashed line, relative to each other. For example, a defined tightening moment can be adhered to when screwing the foam pump 6 to the coupling piece 23 to ensure that the foam pump 6 is aligned correctly relative to the rest of the storage holder and the housing 2.

In the embodiment shown in FIG. 4, the foam pump 6 is screwed to the coupling piece 23. This assembly is subsequently pushed tight onto the plug 22. It goes without saying that other ways of attachment are possible. Thus, it is also possible that the pump is attached by means of a snap or click connection to the coupling piece. An embodiment in which the coupling piece is screwed onto or bonded to the plug is also conceivable. In these embodiments, guidance means can also be applied to align the pump, coupling piece and plug at a correct angle relative to the longitudinal axis.

In the embodiment depicted in FIG. 4, the coupling piece 23 includes a threaded neck 24 and foam pump 6 includes a matching thread 25 applied to the inside of a cap 26 (FIG. 3). This is an advantageous embodiment of the invention. Foam pumps with such a thread 25 are produced in large quantities for screwing onto a threaded neck of the bottle of a hand soap dispenser. The foam pump 6 shown in FIG. 3 is also a typical example of this. It is thereby possible to use the foam pump 6 in both soap foam dispensers according to the invention and hand soap dispensers, by which means advantages of scale are consequently achievable in production.

To be useful in such dispensers, which generally do not have a flexible wall and are used in a standing position, the illustrated foam pump 6 is provided with an air passage 28 located in an outer wall 27 of the air chamber 13, which emerges into the fluid reservoir, the bottle, at one end. At the other end, the air passage 28 is, at least indirectly, in contact with the outside air. This serves to aerate the bottle. As mentioned above, this is not necessary for the invention because use may be made of a soap reservoir 8 with a flexible wall 9. The wall 9 collapses as the soap reservoir 8 empties. The air passage 28 may even be somewhat of a hindrance, as it can also be a source of contamination of the pump and of the soap flowing through it. The air passage 28 is also the reason that hand soap dispensers can only be used standing up. In a hand soap dispenser with a bottle as a reservoir, the hole forms an open connection between the foam pump 6 and the contents of the bottle. In the shown dispenser, according to the invention, this is of less concern because the short suction tube 10 is already clamped onto the plug 22 so that soap can only flow through the foam pump 6 through the suction tube 10. Contamination of the pump could occur, however, without further measures.

Nevertheless, to be able to use this pervasive type of foam pump 6, the coupling piece 23 is adapted to close off the air passage 28. At least a part of the inner surface of the coupling piece 23 abuts the outer wall 27 of the air chamber 13, to this end, in such a manner that the air passage 28 is closed off.

In the illustrated embodiment, the coupling piece 23 performs another important function, as it is adapted to connect the cap 26 to the rest of the foam pump 6, in this case the outer wall 27 of the air chamber 13. The coupling piece 23, therefore, plays a role in connecting the parts of the foam pump 6. Upon screwing together the foam pump 6 and the coupling piece 23, a front edge 29 of the coupling piece 23 comes to rest against a supporting area 30, which forms part of the outer wall 27 of the air chamber 13 so that this outer wall 27 is pressed against the cap 26.

As can be seen in FIG. 2, among others, the foam pump 6 mechanically contacts the operating handle 3 and is actuated by means of the operating handle 3, whereby the nozzle 5 moves in the direction of the soap reservoir 8. To prevent the entire foam pump 6 from being pressed into the bag, and thus no foam being dispensed, the foam pump 6 is rigidly coupled to the housing 2 in a manner which will be further explained below.

The soap reservoir 8 has a rectangular surrounding housing 31 around the wall 9, which may, for example, be made of stiff cardboard. This housing 31 eases the transport of the soap reservoir 8 and placement in the housing 2. An embodiment in which eyes, loops, or a seam with holes are provided on the bag so that it can be suspended from the rear wall 7 on the inside is, however, also possible.

Figure 5:
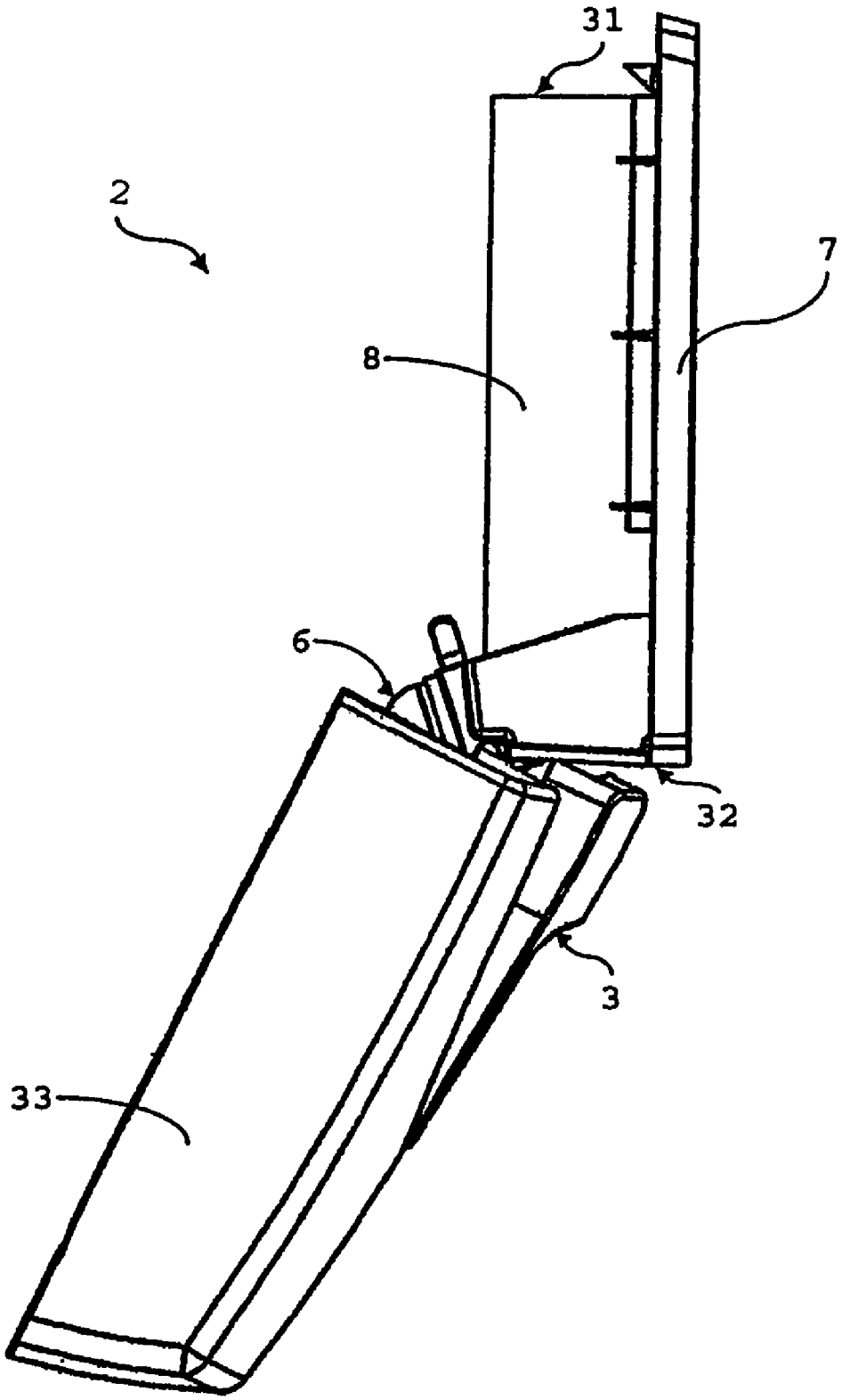
FIG. 5 is a side view of the foam dispenser of FIG. 1 in folded open condition.

As depicted in FIG. 5, the housing 2 may comprise two parts, namely, a carrier 32 and a hinging hood 33. An embodiment in which the hood 33 can be completely detached is also a possibility. Such a modular build has the advantage that if parts are damaged, they are easily replaceable. Furthermore, different markets can be supplied by, for example, different hoods. The operating handle 3 may also be replaceable so that the housing 2 is not only suitable for the specific foam pump 6 depicted here.

The housing 2 is provided with a latching arrangement, not shown in further detail in FIG. 5, to hold the hood 33 in position during normal use. When the soap reservoir 8 is empty, the hood 33 may be released and opened, and the entire storage holder, including the foam pump 6, is taken out and replaced by a full soap reservoir 8.

Figure 6:
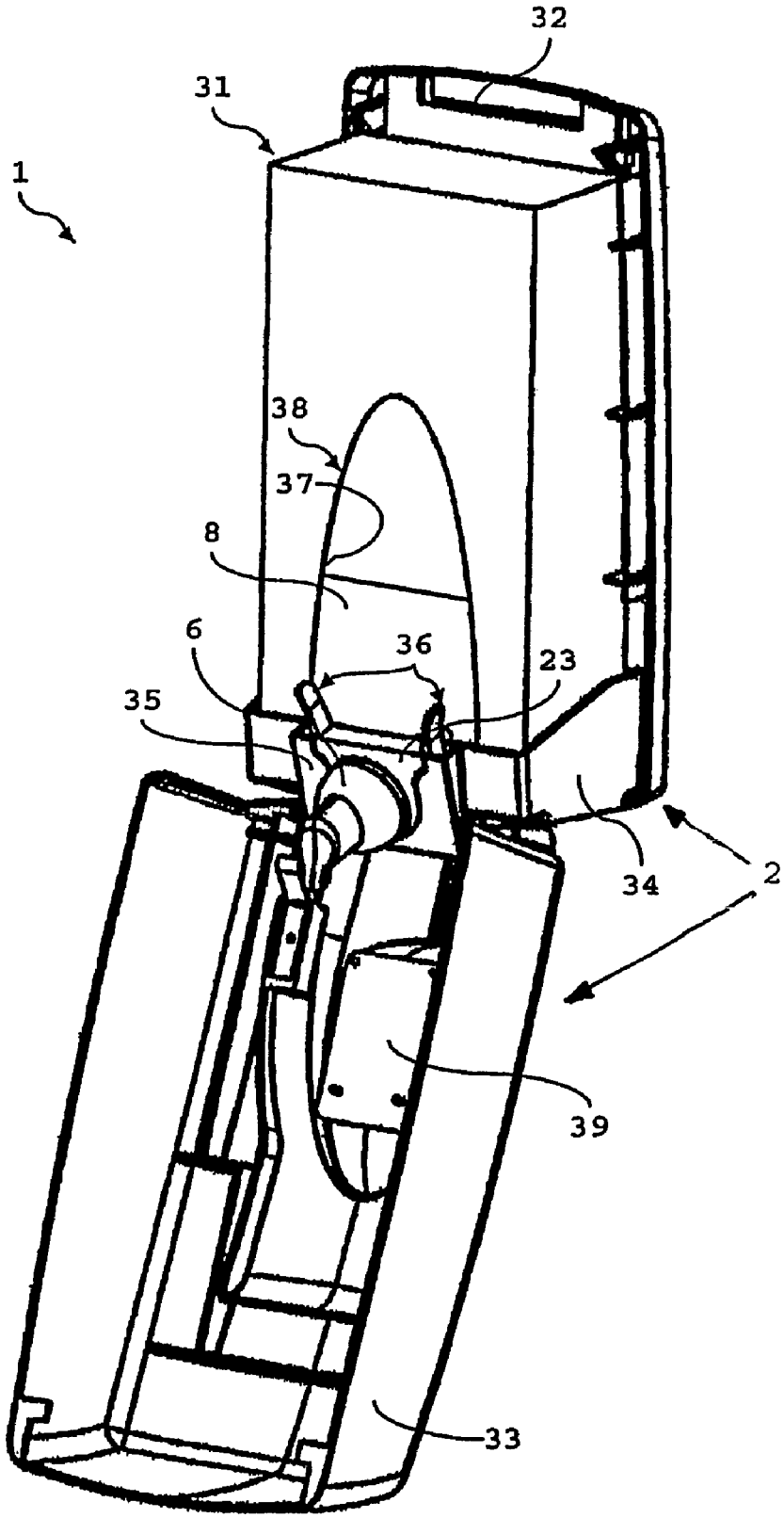
FIG. 6 is a perspective view of the foam dispenser in folded open condition.

FIG. 6 depicts a perspective view of the soap foam dispenser 1 in folded open condition. In this embodiment, in which the storage holder is provided with a surrounding housing 31 with a rigid wall, the storage holder is simply placed in a shallow tray, the so-called "box holder 34," in the carrier 32.

Also visible is the fact that the foam pump 6 may be attached to the housing 2 by means of the coupling piece 23 upon placement of the storage holder. According to the invention, the coupling piece 23 is slid into an adapter 35 and locked in by two latches 36. By these means for securing and positioning the foam pump 6, on the one hand, the foam pump 6 may be rigidly coupled to the housing 2 during use so that the force exerted by the user through the operating handle 3 on the foam pump 6 can be resisted. The latches 36 prevent unintended release during use. On the other hand, the orientation of the foam pump 6 may also be determined so that the nozzle 5 points downwards and foam lands where the user of the dispenser 1 expects it to.

Differently designed combinations of coupling piece 23 and adapter 35 are possible. A different type of locking of the coupling piece 23 is also possible. By using the coupling piece 23, different types of foam pumps can be made suitable for use in one type of housing 2. The coupling piece 23 forms part of the storage holder and is thus included with it.

Attention is again drawn to the modular build of the soap foam dispenser 1 according to the invention. One can manufacture different embodiments of the foam dispenser, which all comprise the same hood 33, foam pump 6 and other standard parts, but differ only in the design of the adapter 35 or the coupling piece 23, or the latching of the coupling piece 23 in the adapter 35. This can be of importance if different types of soap are available, for example, for people with allergies or for use in a workshop or laboratory. It would then be undesirable for a soap reservoir 8 with the wrong contents (e.g., type of soap) to be placed in the housing 2. With an adapter or latch of a specific shape, such an error is avoided. Only one specific type of storage holder can be placed in the housing 2.

In the embodiment according to FIG. 6, an opening 37 is present, defined by an edge 38, in the enclosing housing 31 of the storage holder. When the housing 2 is closed, a transparent cover 39 of the window 4 in the operating handle 3 (FIG. 1) moves in front of the opening 37. Thus, a view is maintained of the contents of the soap reservoir 8, in order to timely establish that the reservoir is getting empty.

Preferably, the edge 38 is a perforated edge and the opening 37 is provided upon placement of the storage holder by tearing off a removable part of the enclosing housing 31 along the edge 38. In such an embodiment, the entire storage holder can be transported before use as a rectangular box, wherein the foam pump 6 lies in the box. If the housing 31 is then torn open along the edge 38, opening 37 comes into existence, from which the foam pump 6 and the coupling piece 23 can be pulled. The foam pump 6 and the connection to the wall 9 of the soap reservoir 8 are thus protected during transport by the enclosing housing 31. The storage holders are easily stackable due to the rectangular shape of the housing 31.

Figure 7:
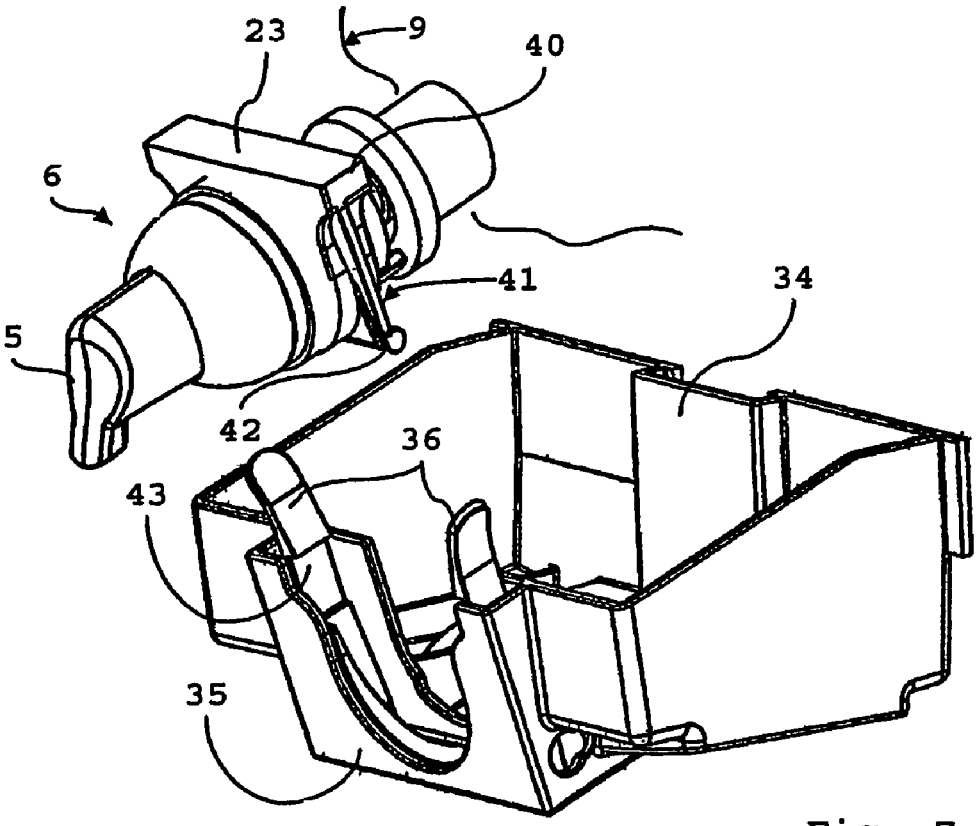
FIG. 7 is a perspective view of a detail of the foam dispenser according to the invention, in which the coupling between the coupling piece and housing is shown.

FIG. 7 provides a perspective view of the assembly of FIG. 4 just prior to placement of the storage holder in the box holder 34, which is part of the housing 2. A number of constructive measures which have been taken to position and secure the foam pump 6 relative to the housing 2 are also visible in this drawing. The coupling piece 23 thus has a cam 40, a rib 41 and a round protrusion 42. The coupling piece 23 is slid into the adapter 35, in this case integral with the box holder 34, to which the latches 36 are also attached. The latches 36 each have a recess 43 with which they engage the cams 40 of the coupling piece 23. Because the foam pump 6 is aligned relative to the coupling piece 23 and the coupling piece 23 relative to the housing 2 by means of the adapter 35, the foam pump 6 cannot be placed lopsidedly in the housing 2. The foam thus always leaves the nozzle 5 in a downwardly directed flow.

In a preferred embodiment of the foam dispenser according to the invention, the latches 36 have a second function. In this embodiment, the adapter 35 is provided with resilient means, not shown, which are supported by the coupling piece 23. The resilient means exert a force which would move the coupling piece 23 out of the adapter 35 if the latches 36 would not keep the coupling piece 23 under tension. If one wants to remove the storage holder, that is, the assembly of soap reservoir 8 and foam pump 6, from the housing 2, then one moves the latches 36 so that the coupling piece 23 is pushed out of the adapter 35 by the resilient means. It is thus easier to handle. Changing of storage holders is thus considerably easy.

Figure 8:
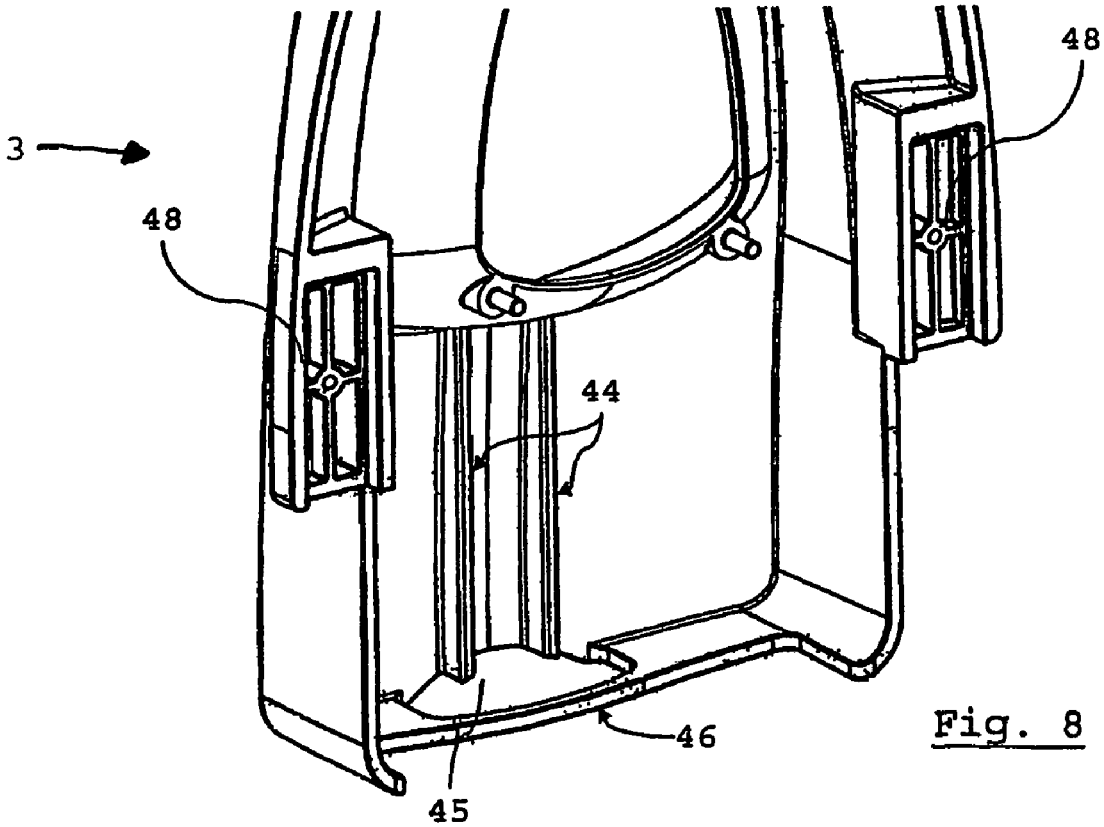
FIG. 8 is a perspective rear view of the operating handle in a foam dispenser according to the invention.

A further constructive measure to make the nozzle 5 point in the right direction will now be explained in further detail with reference to FIG. 8. Here, the operating handle 3 is shown in perspective, seen from behind. At this rear side, which is thus on the inside of the housing 2, two orientation ribs 44 have been provided which clamp a nozzle 5 stuck through a hole 45. It is thereby guaranteed that not only does the nozzle 5 point in the right direction relative to the housing 2, but also that the nozzle 5 points in the right direction relative to the housing 2 and the foam pump 6. After placement of the storage holder in the housing 2, the nozzle 5 will, upon closing of the hood 33, stick through the hole 45 and be clamped on both sides and aligned by the ribs 44 which, for a better functioning, may taper from above to below. Lopsidedness of the nozzle 5 is thereby corrected.

At the rear side of the hole 45, the operating part 11 of the operating handle 3 includes an edge 46. In the unhoped-for-event that the foam pump 6 should start to move brusquely during its lifetime, then, with this edge 46, the operating part 11 of the foam pump 6 may be manually returned to its initial position after actuation. When the operating handle 3 is returned to the initial position, the edge 46 will encounter a part, denoted by reference number 47 in FIG. 4, of the operating part 11 that is thus entrained in a direction opposite to the direction of actuation of the foam pump 6. The edge 46 of the operating part 11 of the operating handle 3 thus ensures that the operating handle 3 functions as a kind of carrier.

Figure 9:
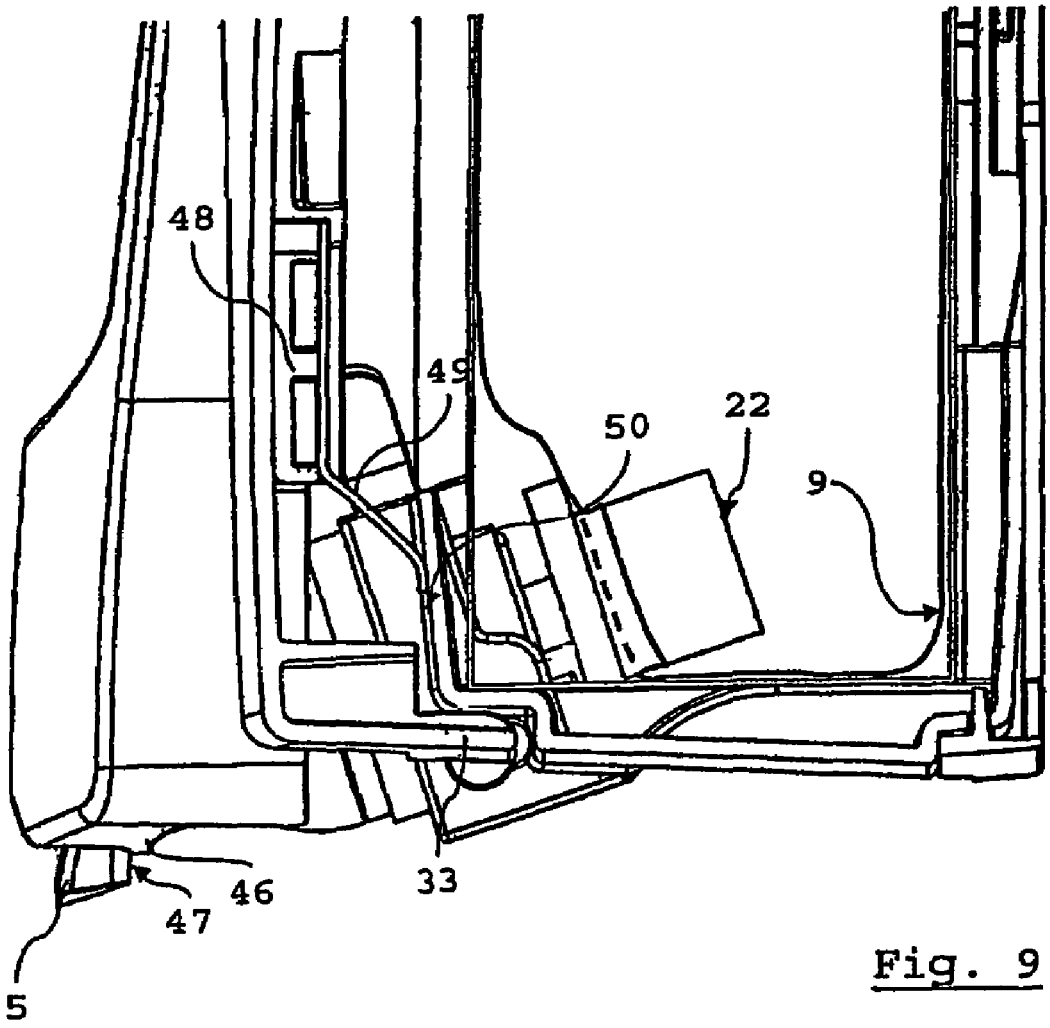
FIG. 9 is a cross-sectional side view that depicts the manner in which the handle is suspended in the housing.

The operating handle 3 can be moved back by pulling it, but in a preferred embodiment of the invention, resilient means are fitted to points of suspension 48 of the operating handle 3, which ensure an automatic rebounding of the operating handle 3 after a stroke of the pump. In FIG. 9, such a resilient element 49 is shown, which can, for example, consist of a bent strip of metal or elastic plastic. The resilient element 49 is attached to the point of suspension 48 at one end, for example, by means of a screw. When the hood 33 is closed, the resilient element 49 is under tension because the other end contacts a supporting area 50 of the box holder 34.

By means of a different choice of material or design of the resilient element 49, or by placing the point of suspension 48 or the supporting area 50 elsewhere, the maximum stroke and/or the maximum force transferable to the operating part 11 is set differently. The same effect can be achieved by moving the point of engagement of the operating handle 3 with the foam pump 6, for example, by using a different adapter or a different coupling piece. Here again, the special advantage of the modular build of the soap foam dispenser 1 according to the invention becomes apparent. With a number of modules, a multitude of embodiments that are each specifically adapted to a certain usage can be provided.

In FIG. 9, it can also be seen how the resilient force of the resilient element 49 is transferred to the nozzle 5, which, as mentioned, forms an integral part of the operating part 11 (FIG. 4), by means of the edge 46.

It will be apparent that the embodiment described above has been given purely by way of example and can vary within the scope of the claims. Thus, the foam dispenser according to the invention is not limited to the dispensing of soap foam. Other foaming substances can be dispensed also. The foam dispenser is also preeminently suited for use in different positions because the bag of soap is closed in an airtight manner and fluid can only reach the pump in one manner. The foam dispenser, therefore, need not necessarily be attached to a wall in the orientation here described in order to function well.

What is claimed is:

1. A foam dispenser, comprising:

a housing;

a fluid reservoir configured for placement in the housing and including an opening;

a plug connected to the fluid reservoir in communication with the opening so as to permit fluid within the fluid reservoir to be withdrawn from the fluid reservoir;

a foam pump including:

an air pump;

a fluid pump;

a closable supply to the air pump;

a nozzle; and a movable operating part, wherein the foam pump is configured to dispense a quantity of foam through the nozzle upon actuation of the operating part in a direction of pumping; and a coupling piece including a first side for connection to the foam pump and a second side for connection to the plug to combine the fluid reservoir, the plug, and the foam pump into a storage holder, the coupling piece being configured to removably and rigidly fasten the foam pump of the storage holder to the housing.

2. The foam dispenser according to claim 1, wherein:

the housing is provided with an adapter in which the coupling piece is received; and the coupling piece and the adapter are provided with one or more elements for fixing and positioning the foam pump relative to the housing.

3. The foam dispenser according to claim 2, wherein:

the adapter is provided with a resilient element that is supported by the coupling piece and with one or more latches that restrain the coupling piece in the adapter under tension.

4. The foam dispenser according to claim 1, wherein the housing is provided with a handle mechanically contacting the operating part of the foam pump for transferring a force in the direction of pumping.

5. The foam dispenser according to claim 4, wherein the handle is coupled to the operating part and the foam dispenser is further provided with a resilient element supported by the housing and exerting a force opposed to the direction of pumping on the handle.

6. The foam dispenser according to claim 4, wherein a maximum displacement of the handle in the direction of pumping or a maximum force transferable to the operating part can be set.

7. The foam dispenser according to claim 4, wherein the nozzle is part of the operating part and the handle is provided with an alignment element for aligning the nozzle.

8. The foam dispenser according to claim 1, wherein the closable supply forms a connection between a space outside the fluid reservoir and the air pump.

9. A storage holder configured for placement in a foam dispenser, comprising:

a fluid reservoir having an opening;

a plug connected to the fluid reservoir in communication with the opening so as to permit fluid within the fluid reservoir to be withdrawn from the fluid reservoir; and a foam pump, including:

an air pump;

a fluid pump;

a closable supply to the air pump;

a nozzle; and a movable operating part, wherein the foam pump dispenses a quantity of foam through the nozzle upon actuation of the operating part in a direction of pumping; and a coupling piece removably connected to both the foam pump and the plug, and configured to fasten the foam pump to a housing within which the reservoir can be placed.

10. The storage holder according to claim 9, wherein the fluid reservoir has a flexible wall to which the foam pump is connected in a substantially airtight manner.

11. The storage holder according to claim 9, further comprising:

a surrounding housing with a rigid wall, suitable for suspension in a housing of the foam dispenser, wherein the wall of the surrounding housing comprises a detachable part for running the foam pump therethrough.

12. The storage holder according to claim 9, wherein the coupling piece comprises a threaded neck and the foam pump comprises a matching thread with which the foam pump is attached to the coupling piece.

13. The storage holder according to claim 9, wherein the foam pump has an air passage, of which one end is located in an outer wall of the foam pump facing the fluid reservoir, wherein the coupling piece is adapted to close off the air passage.

14. The storage holder according to claim 9, wherein the coupling piece is adapted to connect at least two parts of the foam pump to each other.

15. The foam dispenser according to claim 1, wherein the coupling piece enables use of a plurality of different foam pump configurations and a plurality of different fluid reservoir configurations with the housing.

16. The foam dispenser according to claim 1, wherein the foam pump and the coupling piece are configured to be removably secured to one another.

17. The foam dispenser according to claim 16, wherein the coupling piece includes a threaded male member for mating with and engaging threads on a complementarily configured female member of the foam pump.

18. A coupling assembly, comprising:

a coupling piece for establishing communication between a foam pump and a reservoir for containing material to be dispensed by the foam pump, the coupling piece including:

a pump coupling element configured to removably connect to the pump;

a housing engagement element;

a reservoir coupling element for connecting to the reservoir; and a passage extending through the pump coupling element, the housing engagement element, and the reservoir coupling element to enable material from the reservoir to be drawn through out of the reservoir; and an adapter configured to be rigidly associated with a housing of a fluid dispenser, the adapter including:

a coupling piece engagement element for receiving and removably coupling to the housing engagement element of the coupling piece.

19. The coupling assembly of claim 18, wherein the pump coupling element includes a threaded element for engaging a complementarily threaded element of the pump.

20. The coupling assembly of claim 18, wherein the coupling piece engagement element includes a recess for receiving the housing engagement element of the coupling piece and at least one retention element for holding the housing engagement element of the coupling piece within the recess.

* * * * *

UNITED STATES PATENT AND TRADEMARK OFFICE

CERTIFICATE OF CORRECTION

PATENT NO. : 7,611,033 B2
APPLICATION NO. : 10/841944
DATED : November 3, 2009
INVENTOR(S) : Wilhelmus Everhardus Ganzeboom It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 395 days.

Signed and Sealed this

Fourteenth Day of December, 2010

David J. Kappos

David J. Kappos
*Director of the United States Patent and Trademark Office*